US005497169A

United States Patent [19]

Wu

[11] Patent Number: 5,497,169

[45] Date of Patent: Mar. 5, 1996

[54] WIDE ANGLE, SINGLE SCREEN, GRIDDED SQUARE-LOOP FREQUENCY SELECTIVE SURFACE FOR DIPLEXING TWO CLOSELY SEPARATED FREQUENCY BANDS

[75] Inventor: Te-Kao Wu, Rancho Palos Verdes, Calif.

[73] Assignee: The United States of America as represented by the Administrator of the National Aeronautics and Space Administration, Washington, D.C.

[21] Appl. No.: 94,331

[22] Filed: Jul. 15, 1993

[51] Int. Cl.[6] ..... H01Q 15/23

[52] U.S. Cl. ..... 343/909; 333/134; 333/202

[58] Field of Search ..... 343/909, 754, 343/753; 333/134, 202

[56] References Cited

U.S. PATENT DOCUMENTS

| | | | |
|---|---|---|---|
| 3,231,892 | 1/1966 | Matson et al. | 343/775 |
| 3,271,771 | 9/1966 | Hannan et al. | 343/756 |
| 3,281,850 | 10/1966 | Hannan | 343/756 |
| 3,864,690 | 2/1975 | Pierrot | 343/909 X |
| 4,017,865 | 4/1977 | Woodward | 343/781 |
| 4,701,765 | 10/1987 | Arduini et al. | 343/909 X |
| 4,814,785 | 3/1989 | Wu | 343/909 |
| 5,017,939 | 5/1991 | Wu | 343/911 R |
| 5,103,241 | 4/1992 | Wu | 343/909 |
| 5,130,718 | 7/1992 | Wu et al. | 343/781 CA |
| 5,162,809 | 11/1992 | Wu | 343/909 |

FOREIGN PATENT DOCUMENTS

| | | | |
|---|---|---|---|
| 2518828 | 6/1983 | France | H01Q 15/22 |

OTHER PUBLICATIONS

Arnaud, J. A. & Ruscio, J. T.; "Resonant Grid Quasi–Optical Diplexer"; *Electronics Letters*; 13 Dec. 1973; vol. 9, No. 25; pp. 589, 590.

G. H. Schennum, "Frequency–Selective Surfaces for Multiple–Frequency Antennas," Microwave Journal, vol. 16, No. 5, pp. 55–57, May 1973.

V. D. Agrawal, et al., "Design of a Dichroic Cassegrain Subreflector," IEEE Trans. on Antennas and Propagation, vol. AP–27, No. 4, pp. 466–473 Jul. 1979.

R. Mittra, et al., "Techniques for Analyzing Frequency Selective Surfaces—A Review," Proceedings of the IEEE, vol. 76, No. 12, pp. 1593–1615, Dec. 1988.

B. A. Munk, et al., "On Stabilization of the Bandwidth of a Dichroic Surface by use of Dielectric Slabs," Electromagnetics, vol. 5, No. 4, pp. 349–373, 1985.

E. A. Parker et al., "Arrays of Concentric Rings as Frequency Selective Surfaces," Electronics Letters, vol. 17, No. 23, p. 881, Nov. 1981.

T. K. Wu, "Single–Screen Triband FSS with Double–Square–Loop Elements," Microwave and Optical Technology Letters, vol. 5, No. 2, pp. 56–59, Feb. 1992.

*Primary Examiner*—Benny T. Lee
*Attorney, Agent, or Firm*—John H. Kusmiss

[57] ABSTRACT

The design and performance of a wide angle, single screen, frequency selective surface (FSS) with gridded square-loop path elements are described for diplexing closely separated signal bands, for example, X- and Ku-band signals in an Orbiting Very Long Baseline Interferometer (OVLBI) earth station reflector antenna system, as well as other applications such as military and commercial communications via satellites. Excellent agreement is obtained between the predicted and measured results of this FSS design using the gridded square-loop patch elements sandwiched between 0.0889 cm thick tetrafluoroethylene fluorocarbon polymer (PTFE) slabs. Resonant frequency drift is reduced by 1 GHz with an incidence angle from 0° normal to 40° from normal.

3 Claims, 9 Drawing Sheets

WIDE ANGLE, SINGLE SCREEN, GRIDDED SQUARE-LOOP FREQUENCY SELECTIVE SURFACE FOR DIPLEXING TWO CLOSELY SEPARATED FREQUENCY BANDS

ORIGIN OF INVENTION

The invention described herein was made in the performance of work under a NASA contract, and is subject to the provisions of Public Law 96-517 (35 USC 202) in which the contractor has elected not to retain title.

TECHNICAL FIELD

The invention relates to a wide angle, single screen frequency selective surface (FSS), sometimes referred to herein as a "dichroic," with gridded square-loop elements for diplexing signals in two closely separated frequency bands, such as X and Ku bands, in a reflector antenna system for an Orbiting Very Long Baseline Interferometry (OVLBI) earth station and for military or commercial communication applications.

BACKGROUND ART

The prior-art Very Long Baseline Interferometry (VLBI) system is presently being adapted to a new approach for radio astronomy involving a radio telescope placed in orbit around the earth. Typically, Very Long Baseline Interferometry (VLBI) involves simultaneous observations from widely separated radio telescopes followed by correlation of the signals received at each telescope in a central processing facility. VLBI has been an important technique in radio astronomy for over 20 years because it produces images whose angular resolution is far higher than that of any other technique.

The National Radio Astronomical Observatory (NRAO) is constructing an earth station at Green Bank, W. Va. to communicate with two orbiting satellites, namely the Russian RADIOASTRON and the VLBI Space Observatory Project (VSOP) of Japan, as illustrated in FIG. 1, to form an orbiting VLBI. The frequency allocations for the communication between an earth station 10 and the two satellites 11 and 12 are in the X and Ku bands as described in Table 1.

TABLE 1

| Reflector Antenna Requirements | | | |
|---|---|---|---|
| Frequency (GHz) | Bandwidth (GHz) | Usage | Polarization |
| 7.22 | 0.045 | RADIOASTRON Uplink | LHCP |
| 8.47 | 0.1 | RADIOASTRON Downlink | RHCP |
| 14.2 | 0.1 | VSOP Downlink | LHCP |
| 15.3 | 0.1 | VSOP Uplink | LHCP |

To meet this dual-band communication requirement, the multireflector antenna at the ground station 10 shown in FIG. 2 has been proposed with a flat panel, frequency selective surface (FSS) 13, sometimes referred to in the literature as a "dichroic." This has been proposed in order to reflect Ku-band signals (13.5 to 15.5 GHz) into one of a pair of feedhorns 14 and 15 as they are received by a primary paraboloid reflector 16, reflected by a hyperboloid reflector 17 and re-reflected by the FSS panel 13 into the one Ko-band feedhorn 14. The X-band signals (7 to 9 GHz) received by the paraboloid reflector 16 and reflected by the hyperboloid reflector 17 are passed by the FSS panel 13 into the Xr-band feedhorn 15.

Alternatively, the RF reflector assembly may consist of just the primary reflector 16, typically of paraboloid configuration, having a primary focal point offset from the line of sight to a satellite. The FSS panel 13 is then interposed between the primary reflector reflector 16 and its focal point. The X-band feedhorn 15 is placed on the side of the FSS panel 13 opposite the reflector 16 to receive RF signals transmitted through the FSS panel 13 designed to be transparent to signals of a selected transmitted frequency $f_t$ in that band. The Ku-band feedhorn 14 is then placed on the same side of the FSS panel 13 as the primary reflector 16 to receive RF signals of a selected reflected frequency $f_r$ reflected by the FSS panel 13, as shown in FIG. 3 of U.S. Pat. No. 5,162,809 by the present inventor.

Because the satellite link is in circular polarization, the FSS panel 13 must have a similar response to left- and right-hand circular polarizations (LHCP and RHCP), and by extension, to transverse electric and transverse magnetic (TE and TM polarization) incident fields. In order to reduce the antenna's noise temperature, the RF insertion loss (including the ohmic loss) of the FSS panel 13 should also be minimized for an incidence angle range from normal to 40°. This then requires a wide-angle FSS panel.

In the past, an array of cross-dipole patch elements were used for the FSS panel design in a subreflector of reflector antennas of Voyager (G. H. Schennum, "Frequency selective surfaces for multiple frequency antennas," *Microwave Journal*, Vol 16, No 5, pp. 55–57, May 1973) for reflecting the X-band waves and passing the S-band waves and the Tracking and Data Relay Satellite System (TDRSS) for diplexing the S- and Ku-band waves (V. D. Agrawal and W. A. Imbriale, "Design of a dichroic Casegrain subreflector," IEEE Trans., Vol. AP-27, No. 7, pp. 466–473, July 1979). The characteristics of the cross-dipole elements of an FSS change drastically as the incident angle changes from 0° (normal) to 40°. As a consequence, a large separation was required for the selected bands to minimize the RF losses for dual band applications. This is evidenced by the reflection and transmission band ratio ($f_r/f_t$) being 7:1 for a single screen FSS panel described by V. D. Agrawal and W. A. Imbriale supra, or 4:1 for a double screen FSS panel described by Schennum, supra, with cross-dipole patch elements. A better dichroic design needed to reflect Ku band signals and pass X band signals, i.e., needed to achieve smaller frequency-band separations, as required by the OVLBI application ($f_r/f_t$=14.5/8.0=1.8) is disclosed in U.S. Pat. No. 4,814,785. However, Ku band RF losses were higher at 40° incidence than at normal due to the resonant frequency shift as the incidence angle changed from 0° (normal) to 40°. This resonant frequency shift was about 1.5 Gz. Thus, what is required is a flat FSS panel having a resonant frequency shift less than 1 GHz, particularly for the TM polarization, due to changes in the incidence angle from normal to about 40° in any direction.

SUMMARY OF THE INVENTION

To satisfy the requirements of a wide angle, single screen, frequency selective surface for diplexing two signals in closely separated frequency bands in communication with orbiting satellites from a ground station, a wide angle FSS panel is provided in accordance with the present invention using a single-screen array of square-loop conductive patch elements symmetrically spaced in a square grid of intersecting x and y conductors with one square-loop patch element evenly spaced from the orthogonal x and y conductors. This gridded square-loop screen pattern is designed for a frequency-band ratio ($f_r/f_t$) in a range of about 1.5 to 2 and supported on a thin (3 mil) dielectric sheet. This thin single screen, gridded square-loop FSS panel is sandwiched between two layers of low loss dielectric material having a dielectric constant <2 and a thickness of 0.0889 cm. For example, to sandwich an FSS panel for the X and Ku bands, the dielectric constant is selected to be 2.2. The resonant frequency of the sandwiched gridded square loop FSS is fairly stable with respect to changes in the incidence angle and polarizations of the RF signals, thereby providing wide angle performance. The grid and the square-loop patch elements can be easily scaled for the particular applications (i.e., RF frequencies bands required), but the dielectric constant and thickness remain constant. The grid dimensions for the sandwiched panel design with fixed dielectric layers and thickness are $W_1=G=0.0205\lambda$, $W_2=0.041\lambda$ and $P=0.3286\lambda$ with respect to the wavelength $\lambda$ of the resonant frequency $f_r$, i.e., the center frequency of the reflection band. With this sandwiched panel design the resonant or center frequency of the transmitted frequency $f_t$ may be closely separated from the reflected frequency $f_r$ with good performance over a wide angle of incidence radiation from 0° (normal) to about 40° from normal. This sandwiched FSS panel also exhibits good performance for RF signals of circular polarization.

The novel features that are considered characteristic of this invention are set forth with particularity in the appended claims. The invention will best be understood from the following description when read in connection with the accompanying drawings.

DETAILED DESCRIPTION OF THE INVENTION

Figure 1:
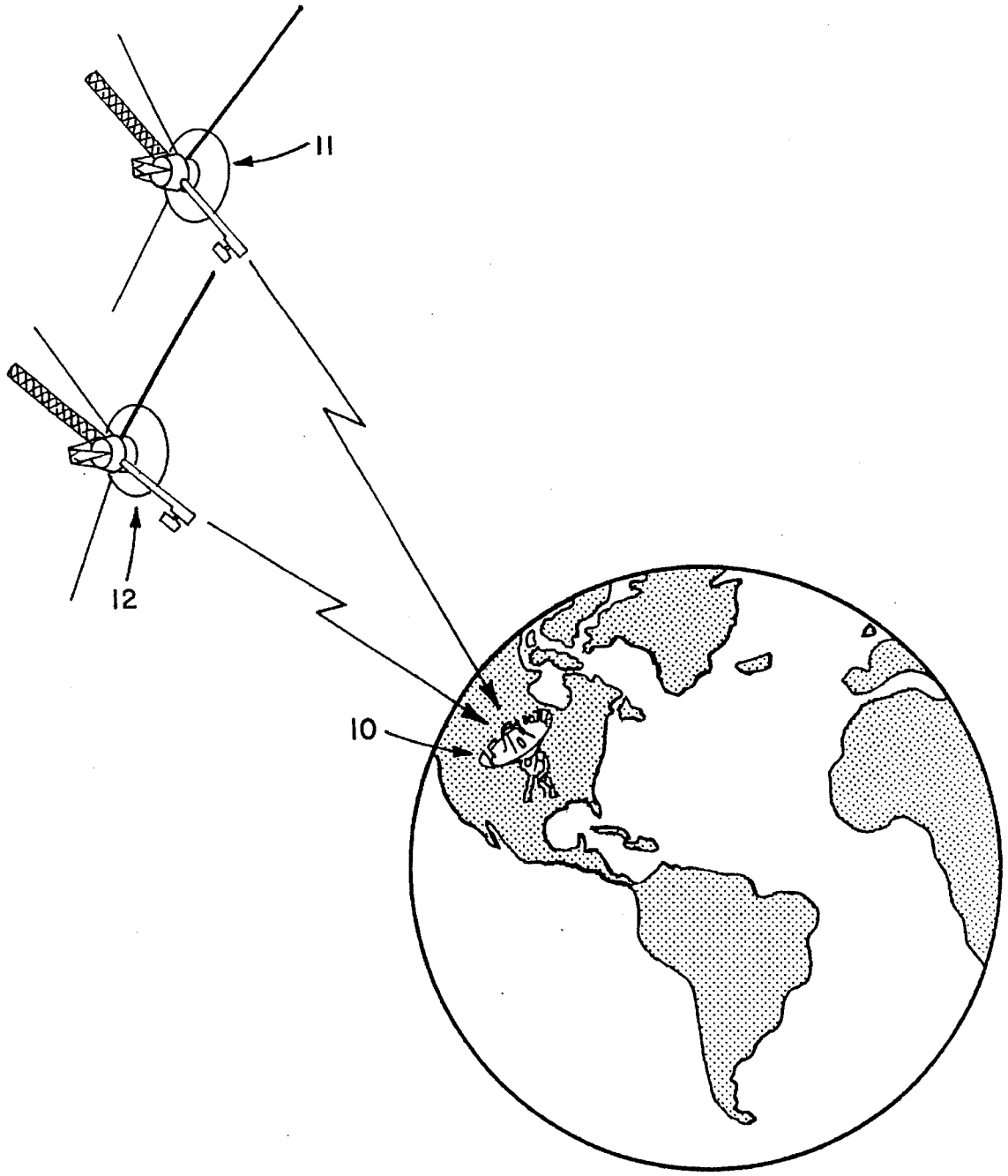
FIG. 1 PRIOR ART
FIG. 1 illustrates the scenario of orbiting very long baseline interferometry (OVLBI) using one earth station and two orbiting satellites transmitting X- and Ku-band signals.
Figure 2:
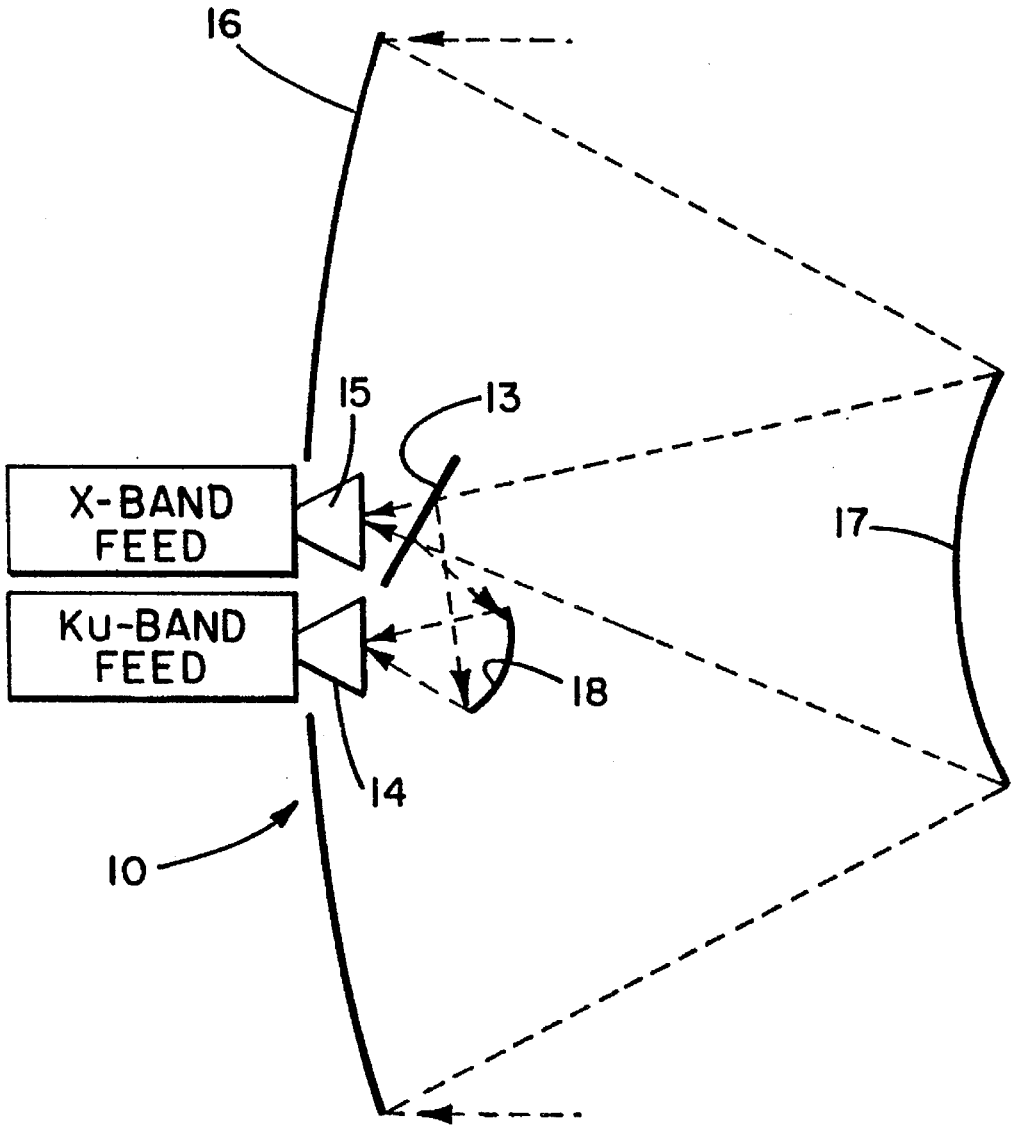
FIG. 2 PRIOR ART
FIG. 2 illustrates schematically a prior-art earth station reflector antenna configuration.
Figure 3:
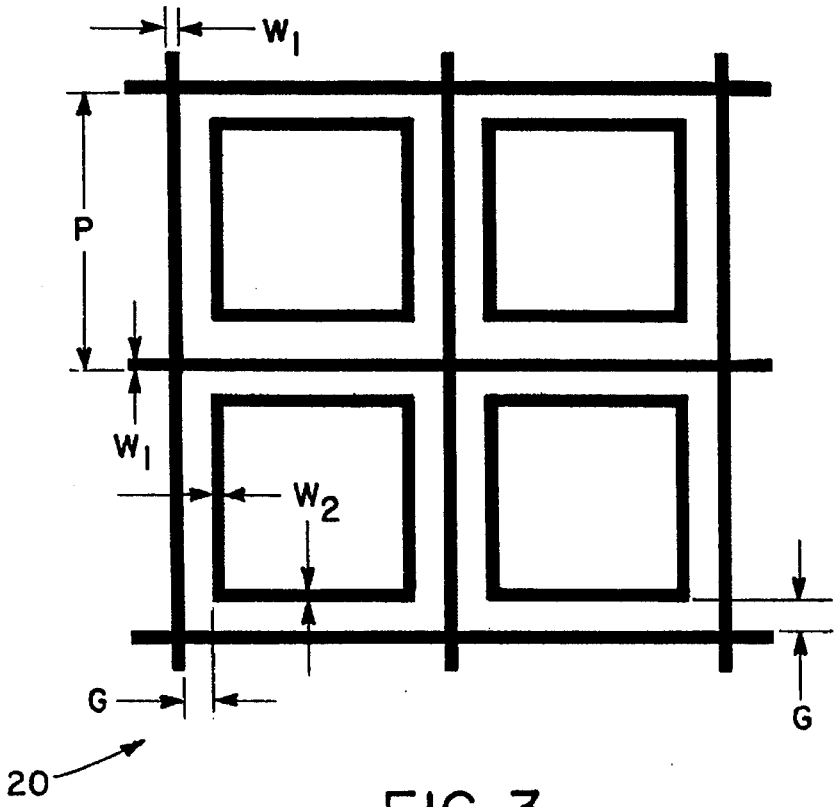
FIG. 3 illustrates a 2×2 segment of a large array of gridded square-loop patch elements of a single screen for an FSS panel.

FIG. 3 illustrates a 2×2 segment of a large array of gridded square-loop patch elements of a single screen for an FSS panel 20.

Figure 3A:
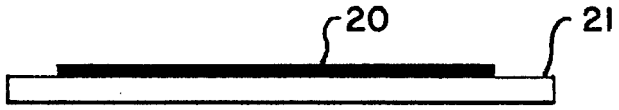
FIG. 3*a* illustrates an end view of a single screen FSS panel having the pattern of gridded square-loop patch elements of FIG. 3 etched in copper on the top surface of a 3 mil Kapton sheet.

As shown in FIG. 3*a*, to loss, the conducting gridded square-loop patches (only two of which are shown in FIG. 3 out of a large array) were printed or etched in copper 20 shown in FIG. 3 on a thin Teflon NM, 21 (having 0.0889 cm in thickness, dielectric constant greater than 2 and loss tangent less than 0.01). The entire FSS panel 20 of griddled sequare-loop elements is illustrated in the end view of FIG. 3*a*. The griddle square-loop patch dimensions for reflected RF signals in the Ku band (13.4 to 15.4 GHz) and passed RF signals in the X band (7 to 9 GHz) are given in Table 2.

TABLE 2

The Dimensions (cm) of Gridded Square Loop FSSs

| $W_1$ | $W_2$ | P | G |
|---|---|---|---|
| 0.05588 | 0.112522 | 0.899922 | 0.5588 |
| 0.042418 | 0.08509 | 0.6779958 | 0.42418 |

Figure 3B:
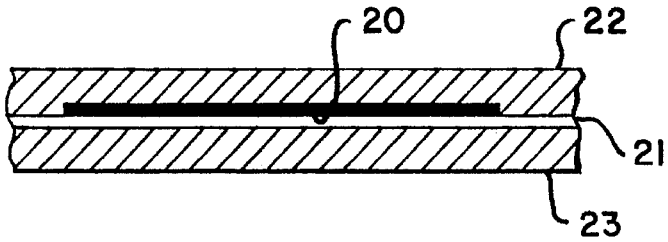
FIG. 3*b* illustrates an end view of the single screen FSS panel of FIG. 3*a* sandwiched between two layers of Teflon (each 0.0889 cm in thickness) having a dielectric constant of 3.5 and a loss tangent of 0.01.

This thin screen FSS can be supported by a fiberglass frame or by a rigid and RF-transparent foam backing (not shown). In either case, the grid 20 on Teflon film 21 is sandwiched as shown in FIG. 3*b* between two layers 22 and 23 of dielectric material 0.0089 centimeters thick. The bonding of the layers may be done with any low loss film adhesive, such as Pyralux, FM 123-2, etc. The analysis and design of this gridded square-loop FSS are based on the accurate and versatile integral equation technique with subdomain expansion functions described in R. Mittra, C. H. Chan and T. Cwik, "Techniques for analyzing frequency selective surface—a review," *Proceedings of the IEEE*, Vol. 76, No. 12, pp. 1593–1615, December 1988.

Figure 4A:
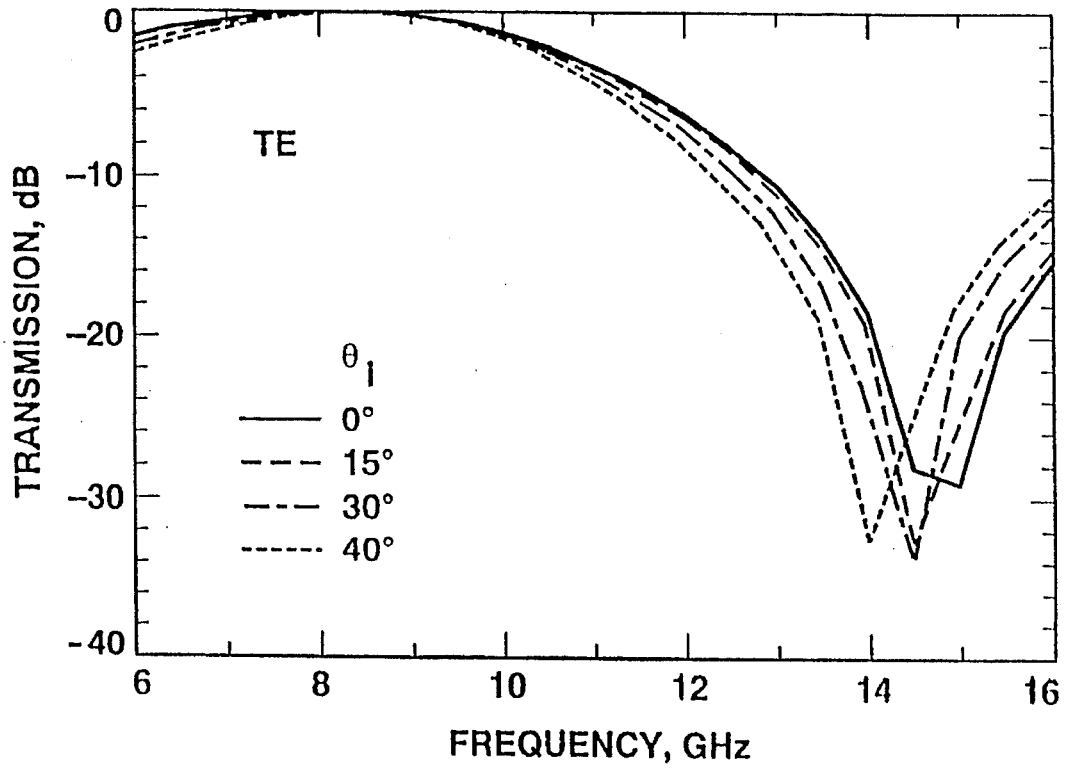
FIGS. 4*a* and 4*b* are graphs of predicted transmission performance of the thin screen FSS of FIG. 3*a* for TE and TM incident fields, respectively.
Figure 4B:
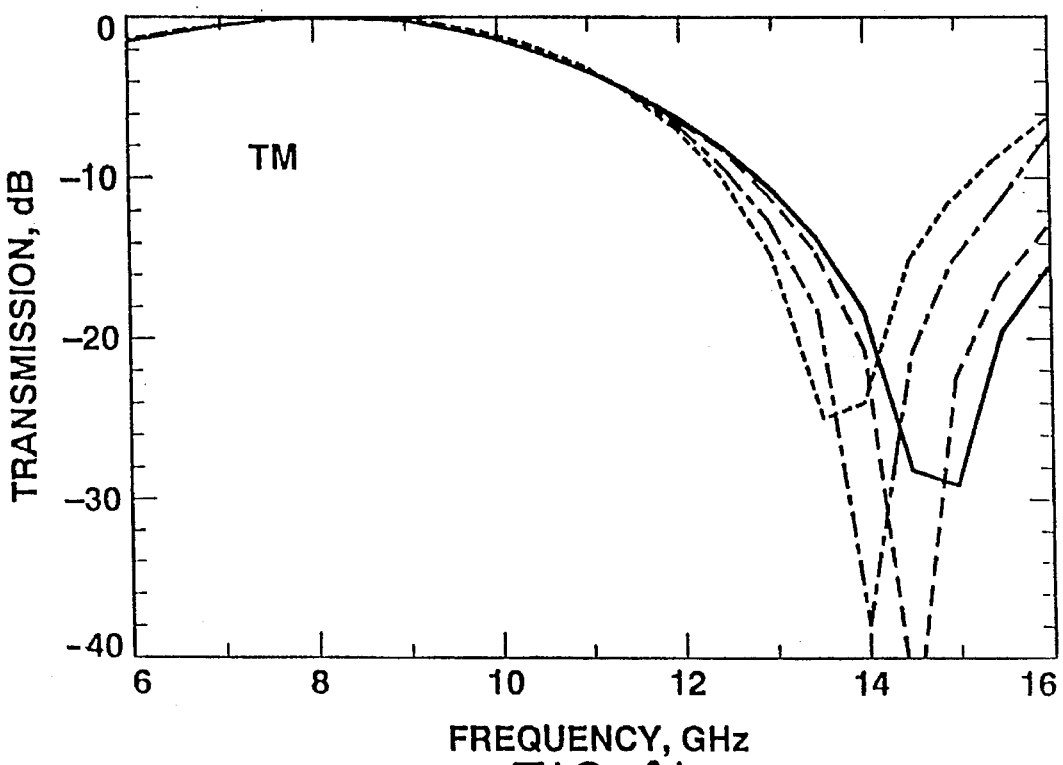
Figure 5:
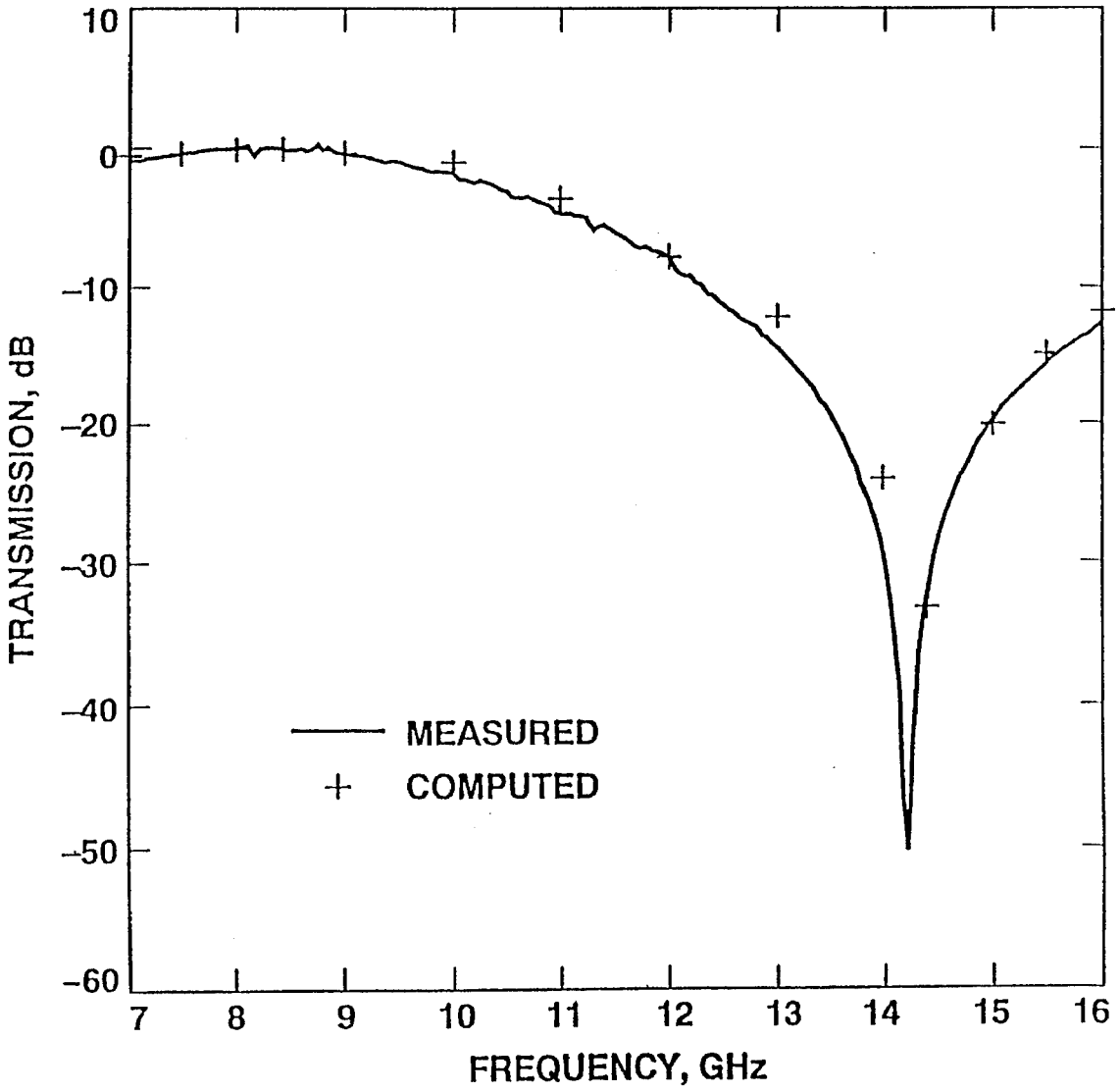
FIG. 5 is a graph of the measured and computed transmission performance of the FSS panel of FIG. 3*a* for TE at 30° incidence.
Figure 6:
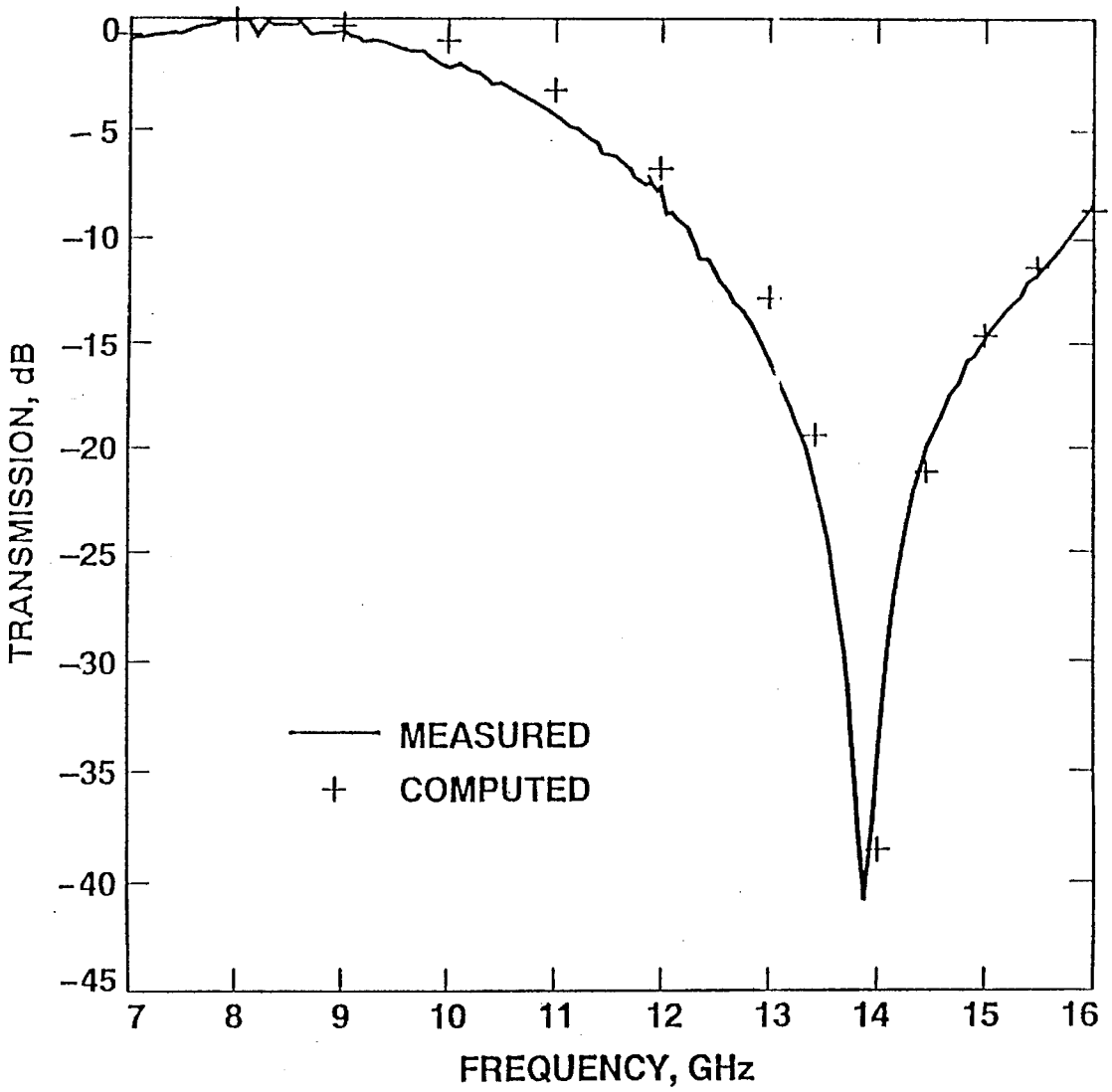
FIG. 6 is a graph of the measured and computed transmission performance of the thin FSS of FIG. 3*a* for TM at 30° incidence.

The predicted TE and TM transmission performance, (dB) of this thin screen gridded square-loop FSS is illustrated in respective FIGS. 4*a* and 4*b* as a function of the incident angle $\theta_1$ and frequency (G HZ) for both TE and TM polarizations. The good agreement between the predicted (computed) and measured performance at $\Sigma_i$=30° incidence is shown in FIGS. 5 and 6 with TE and TM polarization, respectively. This verifies the accuracy of the gridded square-loop FSS's design. Table 3 summarizes the computed RF losses of this thin dichroic.

TABLE 3

Computed Thin Screen FSS Insertion Loss Summary (dB)

| Frequency | | 30° | | 40° | |
|---|---|---|---|---|---|
| (GHz) | $\Theta_i = 0°$ | TE | TM | TE | TM |
| 7.0 | .56 | .84 | .58 | 1.14 | .56 |
| 8.0 | .04 | .1 | .06 | .17 | .07 |
| 9.0 | .2 | .17 | .15 | .16 | .11 |
| 13.5 | .2 | .11 | .08 | .06 | .03 |
| 14.5 | .02 | .01 | .05 | .02 | .15 |
| 15.5 | .06 | .14 | .35 | .19 | .68 |

The loss at 7, 8 and 9 GHz is the transmission loss, and the loss at 13.5, 14.5 and 15.5 GHz is the reflection loss.

It should be noted in the graphs of FIGS. 4*a* and 4*b* that the resonant frequency shifts about 1.5 GHz as the incidence angle is changed from 0° (normal) to 40° for both TE and TM polarization. However, by dielectrically loading the thin dichroic of FIG. 3*a*, the resonant frequency drift due to changes in the incidence angle and the field polarization can be stabilized. [B. Munk and T. Kornbau, "On stabilization of the bandwidth of a dichroic surface by use of dielectric slabs," *Electromagnetics*, Vol. 5, No. 4, pp. 349–373, 1985] Therefore, this thin dichroic of FIG. 3 and FIG. 3*a* is sandwiched between two low-loss Teflon (tetrafluoroethylene fluorocarbon polymer (PTFE)) slabs (with 2.2 dielectric constant and 0.005 loss tangent), as illustrated in FIG. 3*b*, to reduce the resonant frequency drift (or enlarge the reflection bandwidth). Due to the dielectric loading, the dichroic dimensions are scaled down as listed in Table 4 for this improved design.

TABLE 4

| Computed Sandwich FSS Insertion Loss Summary (dB) | | | | | |
|---|---|---|---|---|---|
| Frequency | | 30° | | 40° | |
| (GHz) | $\Theta_i = 0°$ | TE | TM | TE | TM |
| 7.0 | .52 | .75 | .57 | .998 | .58 |
| 8.0 | .04 | .04 | .03 | .04 | .04 |
| 9.0 | .77 | .87 | .51 | .998 | .35 |
| 13.5 | .14 | .09 | .12 | .06 | .1 |
| 14.5 | .02 | .02 | .02 | .02 | .03 |
| 15.5 | .05 | .08 | .14 | .09 | .25 |

Figure 7:
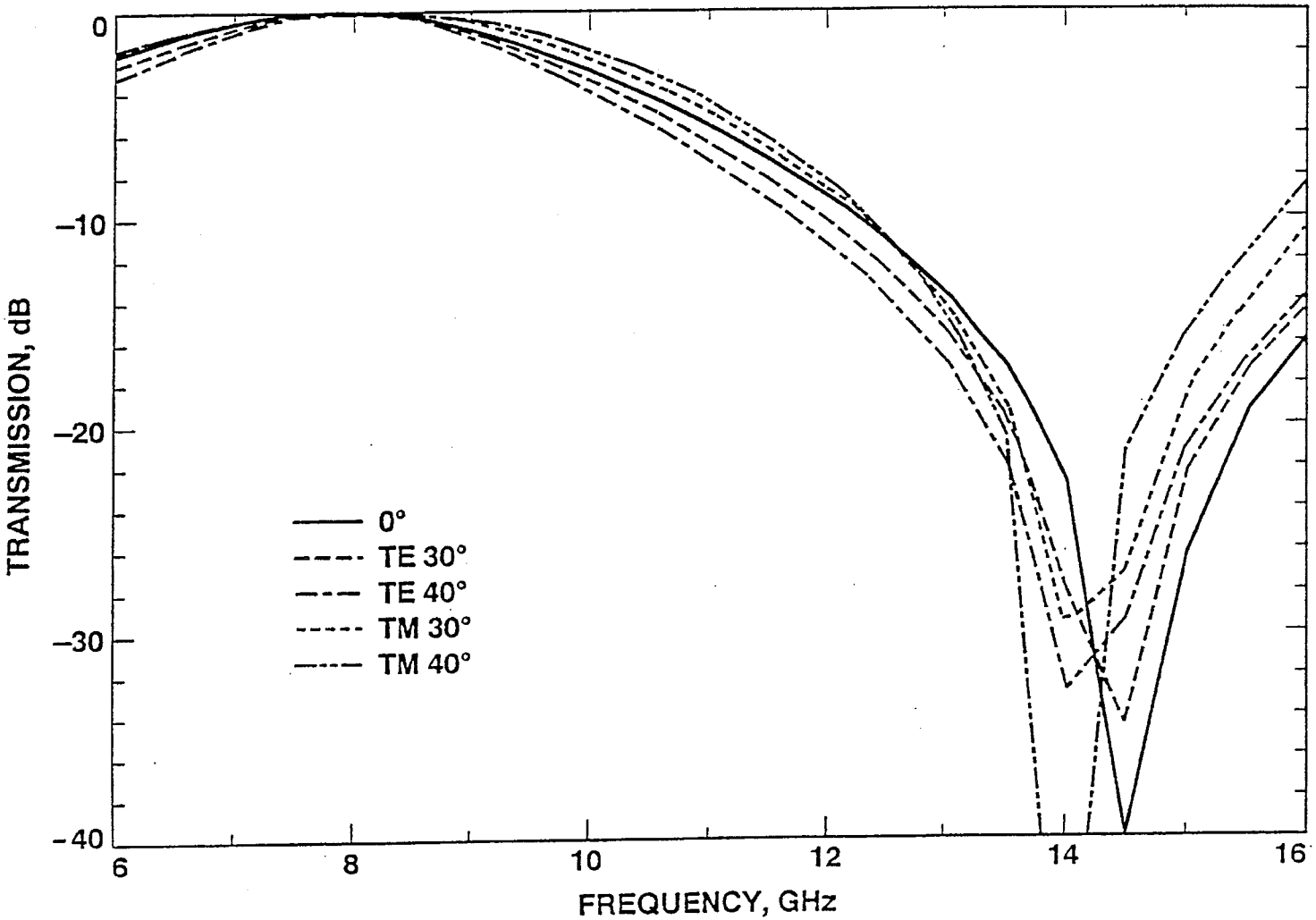
FIG. 7 is a graph of predicted transmission performance of the sandwiched FSS of FIG. 3*b* for TE and TM at 30° and 40° incidence.
Figure 8:
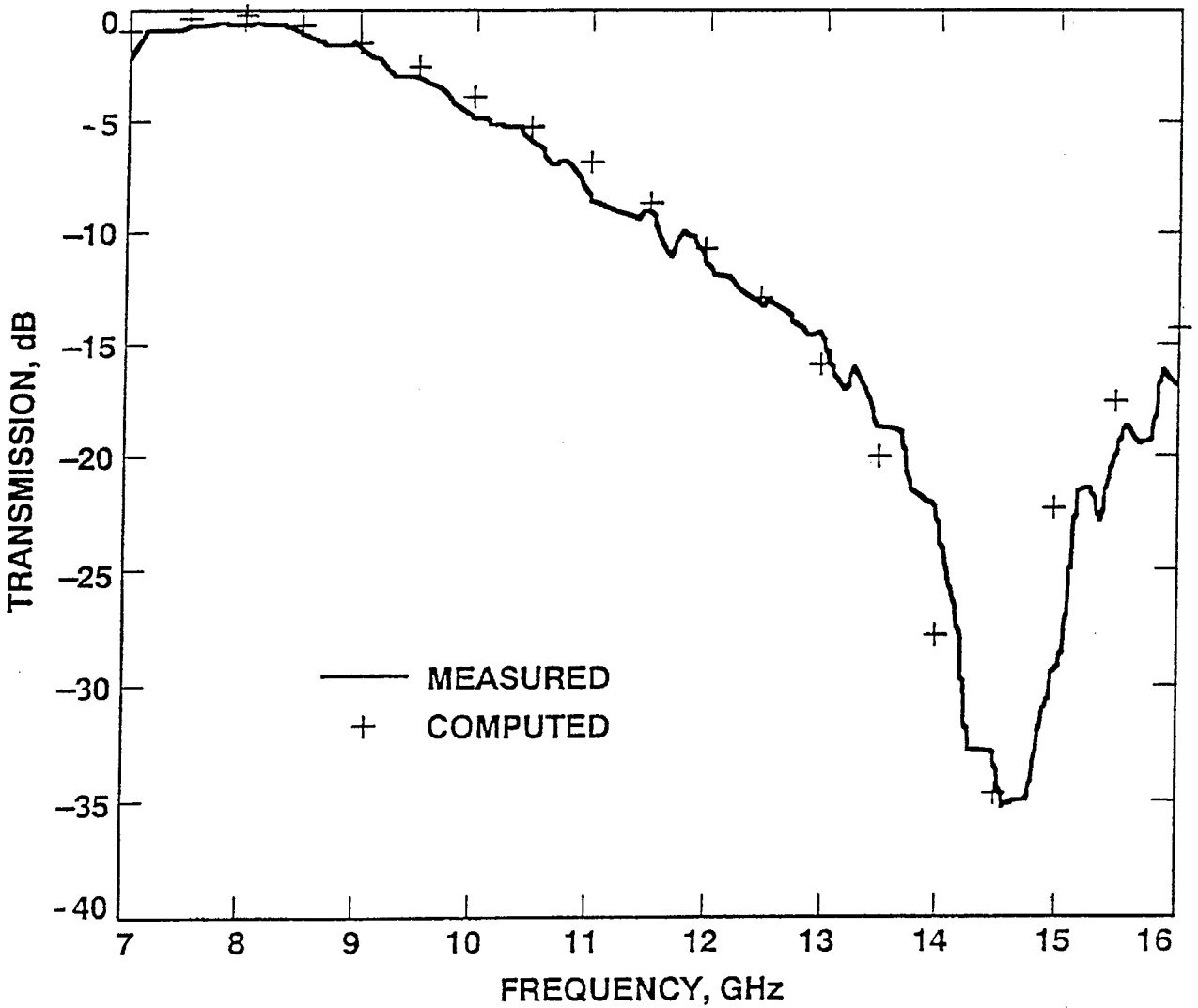
FIG. 8 is a graph of the measured and computed transmission performance of the sandwich FSS of FIG. 3*b* for TE at 30° incidence.
Figure 9:
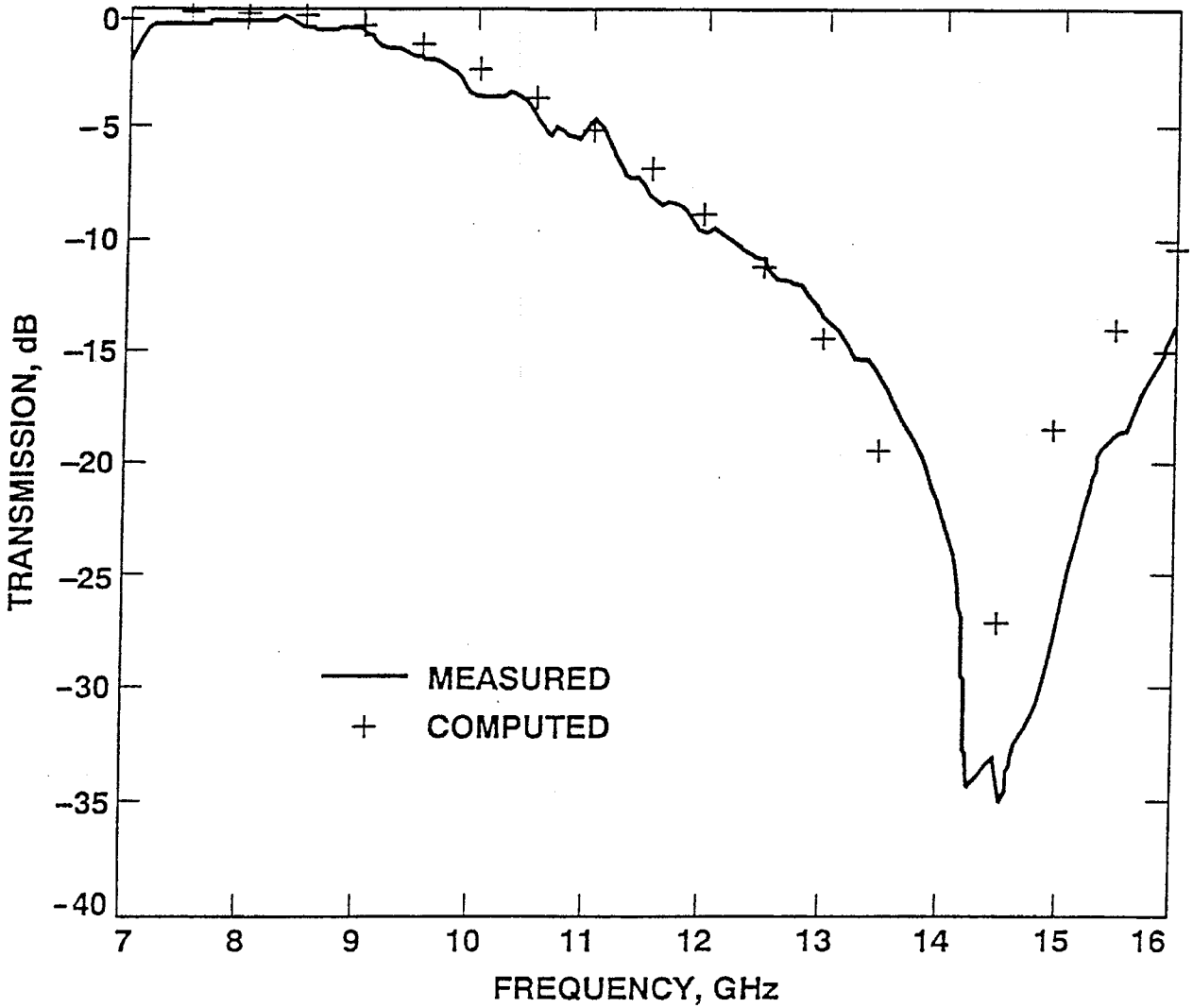
FIG. 9 is a graph of the measured and computed transmission performance of the sandwich FSS of FIG. 3*b* for TM at 30° incidence.

FIG. 7 shows the predicted transmission performance when the improved dichroic is sandwiched between two 0.0889 cm thick Teflon slabs. In summary, the graphs in FIGS. 4*a*, 4*b*, 5, 6 and 7 show the transmission, dB, as a function of incidence angle and frequency, GHz, of square-loop patches and set forth computer and measured performance of square-loop patches shown in FIG. 3. Table 3 summarizes the computer insertion loss at 7, 8 and 9 GHz for transmission and at 13.5, 14.5 and 15.5 GHz for reflection. The dips in the FIGS. 4*a* and 4*b* graphs are the resonant frequencies at the different angles of incidence, which shifts as a function of that angle. FIGS. 5 and 6 then merely show that there is good agreement between predicted and measured transmission performance at a single angle of incidence Again the dip at the resonance frequency at the one angle of incidence. FIG. 7 shows the predicted transmission performance where the square-loop patches are sandwiched between two 0.0089 cm thick Teflon slabs. Note that the resonant frequency (dip) will shift with angle of incidence, but only over a very narrow range. FIGS. 8 and 9 show the good agreement between the predicted and measured results at $\Sigma_i$=30° for TE and TM polarization, respectively, which is representative of changes in incidence angle Σ of up to about 40° from normal. Thus, the resonant frequency shift for this improved design is reduced to less than 1 GHz as the incidence angle is steered from normal to 40°.

Tables 5 and 6 summarize the measured 0.5 dB and 20 dB transmission loss bandwidth, respectively, for both the thin screen FSS and the Teflon sandwiched FSS.

TABLE 5

| Measured 0.5 dB Transmission Loss Bandwidth (GHz) | | | | |
|---|---|---|---|---|
| | Thin Screen FSS | | Teflon Sandwiched FSS | |
| Angle (deg.) | TE | TM | TE | TM |
| 0 | 7.2–8.5 | 7.2–8.5 | 7.2–8.6 | 7.2–8.4 |
| 15 | 7.2–8.5 | 7.2–8.5 | 7.2–8.6 | 7.3–8.7 |
| 30 | 7.4–8.9 | 7.2–8.7 | 7.2–8.4 | 7.2–8.4 |
| 40 | 7.6–8.9 | 7.3–9.0 | 7.2–8.4 | 7.1–8.8 |
| | Common Bandwidth: 7.6–8.5 | | Common Bandwidth: 7.3–8.4 | |

TABLE 6

| Measured 20 dB Transmission Loss Bandwidth (GHz) | | | | |
|---|---|---|---|---|
| | Thin Screen FSS | | Teflon Sandwiched FSS | |
| Angle (deg.) | TE | TM | TE | TM |
| 0 | 13.8–15.5 | 13.8–15.5 | 13.9–15.7 | 14.0–15.8 |
| 15 | 13.7–15.3 | 13.8–15.1 | 14.0–15.6 | 14.0–15.6 |
| 30 | 13.5–15.0 | 13.4–14.5 | 13.8–15.5 | 13.9–15.3 |
| 40 | 13.4–14.7 | 13.1–14.0 | 13.7–15.5 | 13.9–15.1 |
| | Common Bandwidth: 13.8–14.0 | | Common Bandwidth: 14.0–15.1 | |

Note that the frequency band with a 20 dB transmission loss is the FSS's reflection band because most of the incident energy is reflected by the FSS. Typically, the reflection bandwidth increases (or decreases) for the TE (or TM) polarization as the angle of the incidence changes from 0° to about 40°. Therefore, the common reflection bandwidth 13.8–14.0 GHz for both TE and TM polarizations is rather small for the thin screen FSS. However, by sandwiching the thin screen FSS between two Teflon slabs, the common reflection bandwidth increases significantly to 14.0–15.5 GHz, as indicated in Table 6. By comparing Tables 5 and 6, it is seen that the Ku band (13.5 to 15.5 GHz) is improved with less reflection loss with this sandwiched FSS design, and the K band (7 to 9 GHz) performance is improved with less transmission loss at 30° to 40° incidence angles.

Although the design and performance of a single screen FSS with gridded square-loop patch elements have been described for diplexing the X- and Ku-band RF signals in an OVLBI earth station reflector antenna system, it should be noted that the design of the single screen FSS may be scaled for some other reflected frequency ($f_r$) and transmitted frequency band ($f_t$), where the ratio $f_r/f_t$ is in the range from 1.5 to 2, and that in place of Teflon dielectric material (having a dielectric constant of 2.2) some other dielectric material may be used having a dielectric constant greater than 2. The dielectric material and thickness may remain fixed for different designs. For each application design, the grid's dimensions are specified to be:

$$W_1 = G = 0.205\lambda$$

$$W_2 = 0.041\lambda$$

$$P = 0.3286\lambda$$

where λ is the resonant frequency (or the center frequency) of the reflected band (i.e., of the frequency $f_r$, where the ratio of the reflected frequency to the transmitted frequency $f_r/f_t$ is in the range of about 1.5 to 2 and the dielectric constant is selected to be greater than 2. The validity of an FSS panel using the gridded square-loop elements in this design is verified by the excellent agreement obtained between the predicted and measured results and, of greater importance, the resonant frequency drift with change of incidence angle is reduced to less than 1 GHz as the grid is sandwiched between the two slabs of dielectric material 0.0889 cm thick.

I claim:

1. A wide angle, single screen, gridded square-loop frequency selective surface for receiving and diplexing two signals in closely separated frequency bands, one of said two signals being at a first frequency and the other of said two signals being at a second frequency, said frequency selective surface comprising a single-screen array of a square grid of intersecting orthogonal x and y conductive elements defining square spaces therebetween and of square-loop conductive patch elements disposed within respective ones of the square spaces, said patch elements being symmetrically spaced with respect to said square grid of intersecting orthogonal x and y conductive elements with each square-loop patch element having respective sides evenly spaced from corresponding ones of said orthogonal x and y conductive elements of said square grid sandwiched between two layers of low loss dielectric material, each layer having a dielectric constant greater than 2 and a thickness of 0.0889 cm, whereby said wide angle, single screen gridded square-loop frequency selective surface will transmit a received signal at said first frequency and reflect a received signal at said second frequency, said second frequency being closely separated from said first frequency, and wherein each side of each square of said square grid around each square-loop patch element has a length P which is $0.3286\lambda$, said sides of each square-loop patch element being spaced from each of said x and y conductive elements of said square grid with a spacing G, and said x and y conductive elements of each square of said square grid have a width $W_1=0.0205\lambda$ while said square-loop patch elements have a width $W_2=0.041\lambda$ on each side thereof, and said transmitted signal at said first frequency is an X-band signal and said reflected signal at said second frequency is a Ku-band signal, whereby the resonant frequency of said transmitted signal at said first frequency is closely separated from said reflected signal at said second frequency with good performance over a wide angle of incidence of radiation from 0°, normal, to about 40° from normal.

2. A wide angle, single screen, gridded square-loop frequency selective surface as defined in claim 1, wherein said received signal at the first frequency is in the X band and said received signal at said second frequency is in the Ku band, said frequency selective surface being sandwiched between two layers of low loss dielectric material wherein the dielectric constant of said low loss dielectric material for each of said two layers is 2.2, and said dielectric material for each of said two layers has a 0.005 loss tangent.

3. A wide angle, single screen, griddle square-loop frequency selective surface as defined in claim 1 wherein a ratio of said received signal at said second frequency to said received signal at said frequency is in the range of about 1.5 to 2.

* * * * *